United States Patent [19]

Jarrell

[11] 4,207,017

[45] Jun. 10, 1980

[54] EARTHEN TANK AND LINER

[76] Inventor: Hal K. Jarrell, 9225 Katy FW, Suite 325, Houston, Tex. 77024

[21] Appl. No.: 916,935

[22] Filed: Jun. 19, 1978

Related U.S. Application Data

[63] Continuation of Ser. No. 808,032, Jun. 20, 1977.

[51] Int. Cl.[2] ..... E02B 5/00

[52] U.S. Cl. ..... 405/270; 52/169.7

[58] Field of Search ..... 405/83, 84, 270; 52/169.7, 169.14, 742, 169.2

[56] References Cited

U.S. PATENT DOCUMENTS

| | | | |
|---|---|---|---|
| 2,771,745 | 11/1956 | Bramble | 405/270 |
| 2,882,714 | 4/1959 | Gagle et al. | 405/270 X |
| 3,383,863 | 5/1968 | Berry | 405/270 |
| 3,415,022 | 12/1968 | Schaefer et al. | 405/270 |
| 3,474,625 | 10/1969 | Draper et al. | 405/270 |
| 3,849,229 | 11/1974 | Spillane et al. | 405/270 X |
| 3,854,292 | 12/1974 | Nienstadt | 405/270 |
| 3,949,113 | 4/1976 | Draper et al. | 405/270 X |

*Primary Examiner*—Dennis L. Taylor
*Attorney, Agent, or Firm*—Marcus L. Bates

[57] ABSTRACT

A unitary liner for an earthen tank fabricated in situ from a multiplicity of fiberglass panels bonded together to form a unitized membrane which is impervious to brine, crude, and drilling mud. The fiberglass panels are prefabricated and rolled into cylinders for delivery to the tank site where field fabrication of the membrane is completed by attaching overlapping edges of the panels to one another to form a seam. The edges are subsequently bonded together by fiberglass cloth and polyester resin. The fiberglass panels are made up of a plurality of sheets of paper and fiberglass cloth bonded together by fiberglass resin. The cylinder is of a configuration which enables it to be easily handled by workmen.

2 Claims, 12 Drawing Figures

EARTHEN TANK AND LINER

REFERENCE TO RELATED PATENT APPLICATION

Patent application Ser. No. 808,032, filed June 20, 1977, for "Method of Lining and Earthen Tank", of which the instant application is a continuation.

BACKGROUND OF THE INVENTION

During the drilling of boreholes, such as occasioned in seeking oil and gas production, the drilling rigs must have made available a nearby large storage pond, called a mud pit, so that drilling mud can be mixed with various different chemical additives in order to carry out a proper drilling operation. Brine is often used in tremendous quantities in drilling operations, and the handling of thousands of gallons of salt water is costly and must be carefully contained in order to avoid waste and contamination of the immediate area. It is especially important that the brine be contained within a reliable storage pond or tank in order to prevent damage to the underlying aquifier as may occur by the salts and chemicals escaping through the tank bottom and soaking into the fresh water zone. Moreover, vegetation, livestock, and wild animal life must be protected from runoff and spillage of the various chemicals employed in drilling a borehole.

Heretofore, the important of lining earthen tanks have been ignored, or else the tanks have been inadequately lined by cementing together the edges of several polyethylene sheets. This is difficult to properly carry out in the field because the wind blows the lightweight polyethylene about, making it difficult to effect a proper bond at the seams; and furthermore, dirt and debris is blown onto the glue, causing the seam to subsequently part. The polyethylene liner is easily damaged by rocks and other sharp objects. Moreover, air entrapped under the plastic liner tends to float the enter liner to the surface; and therefore, it is not unusual for the workmen to attempt to overcome this drawback by throwing weights, rocks, and other debris into the tank. Of course, this action contributes to the danger of injuring the liner as well as contaminating the contents of the tank.

Therefore, it is desirable to have a tank liner in the form of a unitary membrane which is impervious to drilling mud, chemical additives, and salt water. It would be desirable that the membrane be efficiently fabricated insitu to form a monocoque liner which overcomes the above drawbacks and which is not easily damaged.

SUMMARY OF THE INVENTION

This invention relates to tank liners and specifically to a method of lining an earthen tank with a unitary plastic impregnated fiberglass membrane by bonding fiberglass and paper together with polyester resin to form a panel. The panel is rolled up into a convenient cylindrical roll and transported to the tank site.

The tank is formed by an excavation made into the ground and the panels are unrolled and placed within the tank adjacent to one another with the marginal edges thereof overlapping one another. The overlapped edges are bonded to one another by utilizing polyester resin and fiberglass cloth to thereby effect a unitary membrane which completely covers the entire bottom of the tank.

The marginal, peripheral edges of the membrane preferably extend horizontally away from the tank and an overburden of earth is placed thereon to protect the marginal edges of the liner from livestock and equipment.

A primary object of the present invention is the provision of a unitary tank liner fabricated insitu and made of individual fiberglass panels having the edges thereof bonded to one another.

Another object of the invention is to provide a resin impregnated, unitary fiberglass membrane for lining an earthen tank.

A further object of this invention is to disclose and provide a tank liner fabricated insitu by special fiberglass panels joined together to provide a unitary membrane which is impervious to salt water and drilling mud.

A still further object of this invention is to provide a polyester impregnated fiberglass tank liner made by field joining a multiplicity of panels together to provide a unitary membrane for containing liquids within an earthen tank.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
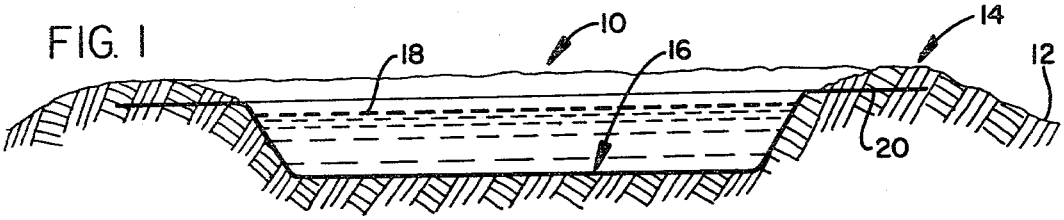
FIG. 1 is a cross-sectional view taken along line 1—1 of FIG. 2 and discloses a tank having a liner made in accordance with the present invention.
Figure 2:
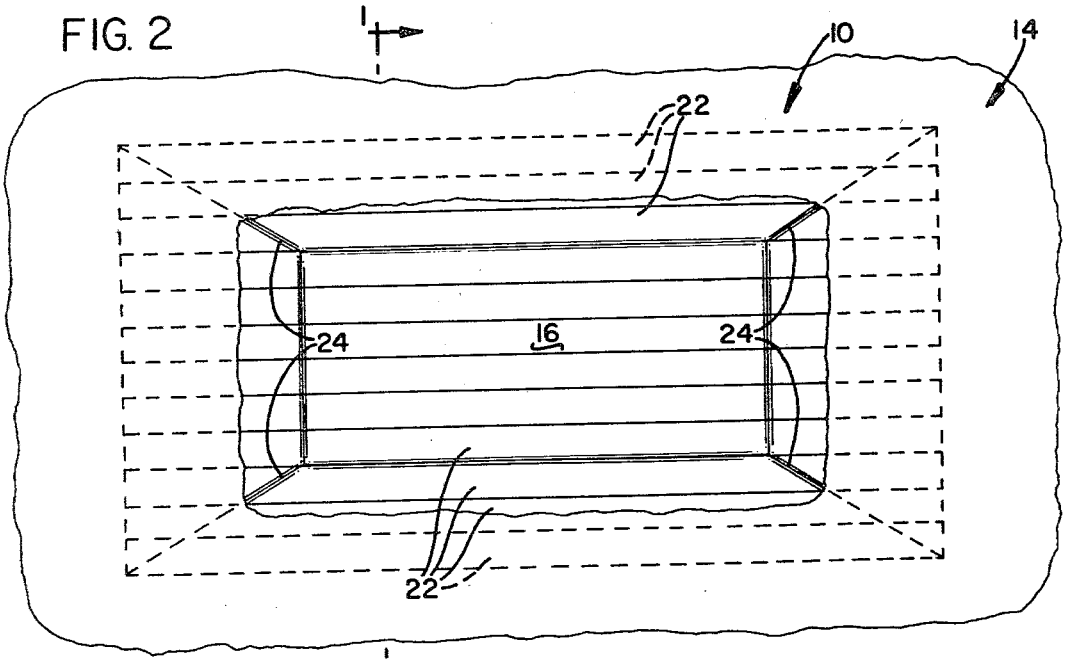
FIG. 2 is a plan view of a tank having a liner made in accordance with the present invention.

FIG. 1 discloses a tank 10 formed into the earth and adapted to hold salt water, crude oil, alkali solution, drilling mud, or various other chemical products. The area 12 surrounding the tank generally slopes downwardly therefrom with an embankment 14 usually being formed about the outer periphery of a tank liner 16 made in accordance with the present invention. Numeral 18 indicates the liquid level of the tank. The outer marginal peripheral edge portion 20 of the tank liner lies horizontally and preferably is covered with earth in the indicated manner of FIGS. 1 and 2.

The tank liner 16 is a unitary membrane and comprises a multiplicity of parallel panels 22 made in accordance with the present invention. The corners 24 of the tank may be at an abrupt angle as illustrated, or alternatively may be smoothly contoured into a long sweeping curve, as may be desired.

FIG. 8 discloses the method of fabricating the tank liner 16. As illustrated, the elongated, parallel, adjacent panel members 22 are arranged with their adjacent edges 25 and 26 slightly overlapping one another, as for example, 2 or 3 inches of overlap for a panel of material 10 or 20 feet in width.

Numeral 27 indicates the step of placing a panel of material 22' adjacent to panels of material 22 already formed into the tank liner. The material of sheet 22' is laid down by unrolling the rolled up cylinder of material 122.

Numeral 28 indicates a reinforced lapjoint made insitu in accordance with the present invention. The lapjoint is formed by sandblasting the overlap area in the indicated manner of numeral 30 by employment of sandblasting equipment 32 having an outlet nozzle 34 of conventional design. Numeral 36 indicates plastic resin which has been applied to the sandblasted area.

Figure 3:
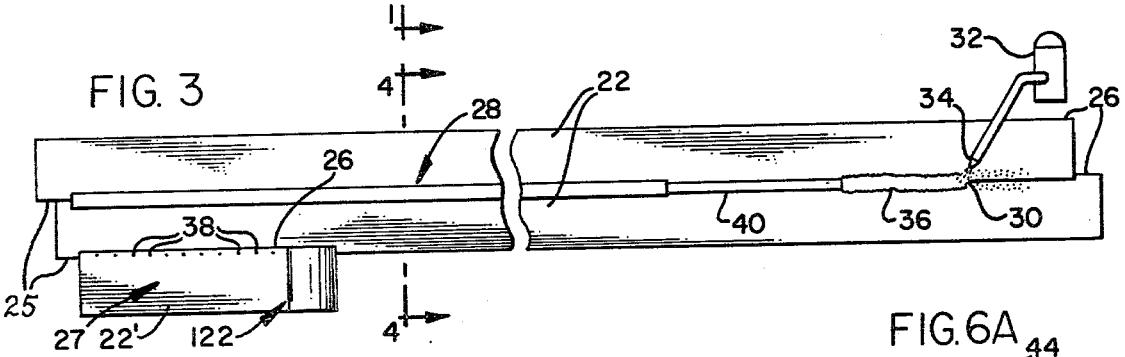
FIG. 3 is a enlarged, broken, top plan view which discloses the tank of FIGS. 1 and 2 under construction.
Figure 4:
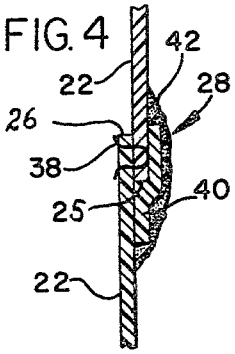
FIG. 4 is a cross-sectional view taken along line 4—4 of FIG. 3.

As seen in FIGS. 3 and 4, the roll of material 122 is unrolled and panel 22' properly overlapped respective to the last laid panel, whereupon the adjacent panels are attached to one another by staples 38. Numeral 40 indicates a six inch width of reinforcement fiberglass matt bonded to the margins of two adjacent panels to reinforce the seam 28. Numeral 42 shows the fiberglass resin which is applied to complete the seam 28.

Figure 5:
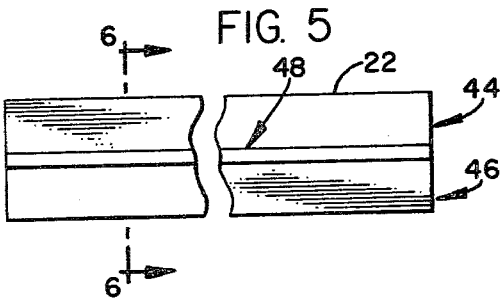
FIG. 5 is a top plan view of part of the tank liner apparatus disclosed in FIGS. 1—3.
Figure 6A:
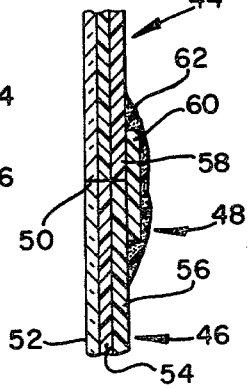
FIGS. 6 A and 6 B show different embodiments of cross-sectional views taken along line 6—6 of FIG. 5.

In FIGS. 5 and 6, numerals 44 and 46 indicate two sheets of material which are joined together to form a panel. Numeral 48 indicates a joint where reinforced material is placed at the longitudinal interseam 50 for effectively bonding the individual sheets of material together during the manufacture thereof.

Each sheet of the panel of material comprises a lower layer 52 of craft paper, a layer of fiberglass matt 54, which preferably is 1½ ounces per square foot, and is available from Fiberglass, Inc., Garland, Texas, with polyester resin 56 and 58 forming the outer surface. The polyester resin is a special blend comprised of iso and artho polyesters which impart flexibility into the panels and is available from Cook Paint and Varnish Company, Kansas City, Kansas.

The outer surface adjacent the interface 58 is not sandblasted for the reason that the fiberglass reinforcing strip 60 is affixed to the outer surface of the panel with fiberglass resin 62 before the polyester resin 56 has completely cured.

Figure 7:
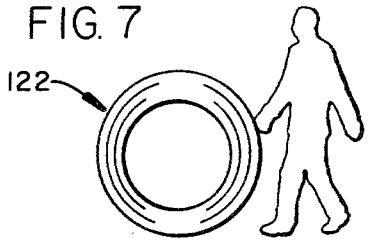
FIG. 7 is an end view disclosing the material of FIG. 5 in a rolled up configuration.

The panels preferably are comprised of two 100 feet lengths of five feet wide fiberglass sheets which results in a 100'×10' panel. The panel can be rolled into a cylinder 122, as illustrated in FIGS. 3 and 7.

Figure 8A:
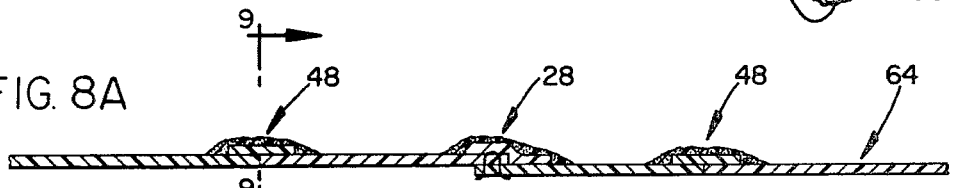
FIGS. 8 A and 8 B show different embodiments of cross-sectional side views of the tank liner of the present invention.
Figure 8B:
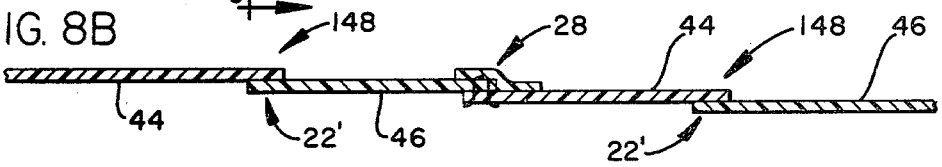
Figure 9:
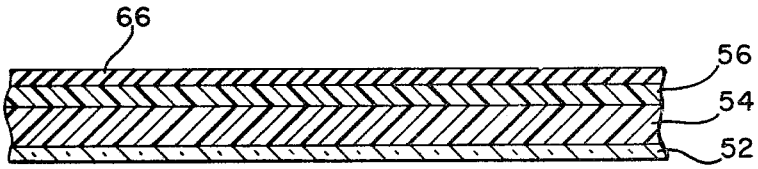
FIG. 9 is a cross-sectional view taken along line 9—9 of FIG. 8; and, FIG. 10 is a cross-sectional view of another embodiment of this invention.

FIGS. 8 and 9 set forth the constructional details of the completed tank liner. As seen in FIGS. 8A and 9, the factory splice 48 joins a plurality of sheets together to provide a multiplicity of panels which are joined together by a field splice 28 so that the tank liner comprises a membrane fabricated insitu in accordance with the method of the present invention.

Figure 6B:
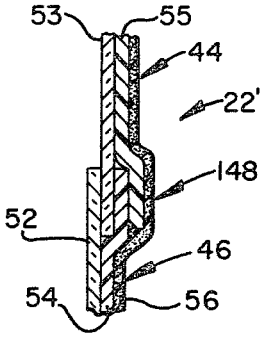

FIGS. 6B and 8B illustrate another embodiment of the invention wherein the individual panels are fabricated from sheets having the marginal adjacent edges thereof overlapped and bonded together. The papers 52, 53 are overlapped and bonded to the overlapped fiberglass sheets 54, 55. Polyester 44 and 46 forms the outer surface and completes the panel. Numeral 148 broadly indicates the factory lap seam.

As particularly seen in FIG. 8B, the panels 22' are joined together at 28 in the same manner described above in conjunction with FIG. 8A. The field seams 28 join the panels 22' together to form the tank liner or continuous membrane.

Figure 10:
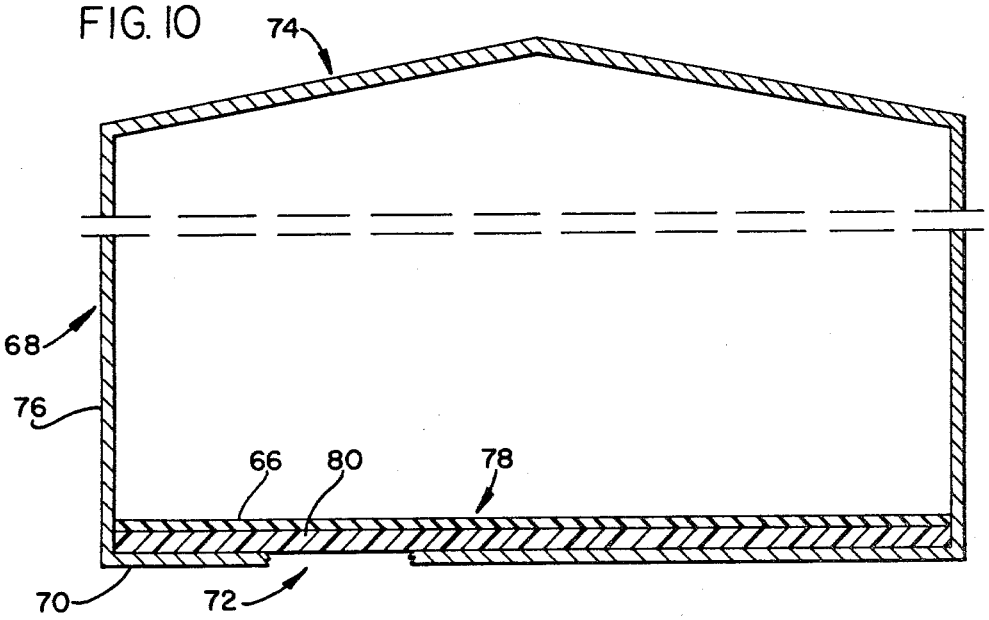

FIG. 10 illustrates a large storage tank 68 having a bottom 70 therein which has been aged at 72, whereupon it will no longer hold liquid and the entire bottom heretofore usually must be replaced. A roof 74 is supported by the tank sidewalls 76 in the usual manner.

The bottom of the tank is repaired in the manner indicated by numeral 78 by providing a monolithic new plastic floor therewith in accordance with the present invention. The new floor is comprised of spraying foam plastic material 80 to a depth of two to four inches into the bottom of the tank, with the foam bottom being carefully applied so as to achieve a smooth, level floor. Inlet and outlet holes are marked so that they can be opened later on. A layer of rubber-like material 66 of about ⅛ to ¼ inch in thickness is next applied over the entire surface of the floor. The rubber-like material is made of Urethane plastics which air dries to provide a resilient, impervious, continuous tank bottom. The rubber-like material can also be catalyst cured as is known to those skilled in the art.

In carrying out the method of the first embodiment of the present invention, a plurality of sheets of craft paper are laid in side by side abutting relationship and extended in width and length in an amount slightly greater than the panel being fabricated. The paper preferably comprises two parallel sheets six feet in width, thereby providing ample overage which can be trimmed from the final panel.

Two adjacent, abutting sheets of fiberglass matt five feet in width and one hundred feet in length are laid out in superimposed relationship on the paper with the adjacent edge portions of the fiberglass matt abutting one another. Polyester resin is next sprayed onto the matt and the narrow strip of material 60 is next applied before the polyester resin has set up. Additional polyester resin is applied to the strip 60 by using special paint rollers having a nap cover thereon made especially for the fiberglass industry.

As soon as the fiberglass resin has cured to hardness, which normally is about one hour, the excess paper is trimmed from the edges and the panels are stacked for final cure, which requires one to three days, depending upon the temperature, humidity, and ventilation. The finally cured panels are each rolled into a cylinder 122 and stored until needed to fabricate the tank.

In the second embodiment of the invention disclosed in FIGS. 6B and 8B, the craft paper is laid out on the floor in the before described manner, but with the adjacent, longitudinal edge portions thereof being overlapped, as seen in FIG. 6B at numeral 148. When the sheets of matt are superimposed upon the craft paper, care is taken to overlap the adjacent edges thereof approximately two inches, thereby eliminating the need for the strip of reinforcing matt 60 illustrated in FIG. 6A. The panels are cured and rolled into cylinders as in the before described manner.

The tank site is prepared by excavating a suitable area and using the excavated material to build up the sides thereof. Padding material, such as chip base or sand, is added as needed to make absolutely certain that a suitable bed is presented for receiving the unitary membrane. The rolls of material are next unrolled in the illustrated manner of FIG. 3 and the overlapping edges 25, 26 thereof stapled using a commercial air staple gun, as seen at 38 in FIGS. 3 and 4. In order to properly bond each of the panels to one another, it is essential that the area 30 be sandblasted so as to remove objectional films of material therefrom and further to roughen up an area which is to receive the fiberglass resin, thereby enhancing the bond. The resin and strip 40 is applied at the interface by utilizing the beforementioned roller.

After the membrane has been fabricated insitu, a portion of the excavating material is backfilled at 14, thereby covering the marginal, peripheral edge portion of the membrane to prevent future damage thereto.

The present invention provides a unitized membrane which lines an earthen tank in an improved and unusual manner, and thereby prevents leakage of objectionable chemicals into the surrounding area.

I claim:

1. A unitized earthen tank liner formed by a unitary, reinforced, fiberglass membrane built insitu which provides an impervious liner in an earthen tank;

said membrane has a bottom, sloped sidewalls connected to said bottom, and a horizontally disposed, marginal edge portion which extends respective to the earthen tank such that an overburden of earthen material can be placed thereon to thereby protect the peripheral edges of the membrane and also anchor the sides of the membrane respective to the earth;

said membrane being made from a multiplicity of panels of polyester resin impregnated fiberglass material having a paper backing bonded thereto by said resin;

said panels being arranged parallel to one another with adjacent marginal, longitudinal edges thereof being overlapped, stapled, and bonded together by a strip of fiberglass material impregnated with polyester resin;

each of said multiplicity of panels being made of a plurality of sheets of fiberglass material bonded to said paper backing with said polyester resin, adjacent ones of said sheets of fiberglass material being arranged to abut one another;

said sheets of fiberglass material are bonded together by a strip of fiberglass cloth impregnated with polyester resin and being superimposed over adjacent marginal abutting edges of said sheets of bonded fiberglass cloth to provide an elongated panel of liner material, so that said elongated panel can be rolled and transported to the earthen tank, whereupon the aforesaid tank liner can be fabricated insitu.

2. An earthen tank construction which has an impervious liner of unitary construction fabricated insitu comprising:

a multiplicity of very long panels which are of a size to be delivered to the tank site in a rolled configuration; each of said panels being fabricated from adjacent sheets of fiberglass material impregnated with polyester and bonded to a fibrous backing to provide a very long panel sufficiently thin to enable the aforesaid rolled configuration to be achieved;

said panels being placed adjacent to one another on the floor of the earthen tank and bonded together at the longitudinal marginal edges thereon to provide a continuous membrane which forms a floor, sidewalls, and outer marginal edges of said impervious liner;

said adjacent sheets of fiberglass material being arranged to abut one another, said sheets of fiberglass material are bonded together at the abutting edges by a strip of fiberglass cloth impregnated with polyester resin and being superimposed over adjacent marginal abutting edges of said sheets of bonded fiberglass material to provide said very long panel of liner material, so that said very long panel can be rolled and transported to the earthen tank, whereupon the aforesaid tank liner can be fabricated insitu;

said sidewalls slope upwardly from said floor and then turn horizontally into said marginal edge, and an overburden of earthen material is placed on said marginal edge to anchor the tank wall and prevent damage thereto.

* * * * *